US006280922B1

(12) United States Patent
Lok

(10) Patent No.: US 6,280,922 B1
(45) Date of Patent: Aug. 28, 2001

(54) HIGH CHLORIDE SILVER HALIDE ELEMENTS CONTAINING ACTIVATED PRECURSORS TO THIOLIC STABILIZERS

(75) Inventor: Roger Lok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/533,744

(22) Filed: Mar. 23, 2000

Related U.S. Application Data

(63) Continuation-in-part of application No. 09/224,213, filed on Dec. 30, 1998.

(51) Int. Cl.[7] ..... G03C 1/10
(52) U.S. Cl. ..... 430/611; 430/613
(58) Field of Search ..... 430/611, 613

(56) References Cited

U.S. PATENT DOCUMENTS

| | | | |
|---|---|---|---|
| 1,962,133 | 6/1934 | Brooker et al. | 430/611 |
| 2,440,206 | 4/1948 | Mueller | 430/607 |
| 2,465,149 | 3/1949 | Dersch et al. | 430/611 |
| 2,728,663 | 12/1955 | Allen et al | 430/599 |
| 2,728,664 | 12/1955 | Carroll et al. | 430/608 |
| 2,728,665 | 12/1955 | Leubner et al. | 430/599 |
| 2,756,145 | 7/1956 | Ballard et al. | 430/607 |
| 2,935,404 | 5/1960 | Dersch | 430/446 |
| 3,047,393 | 7/1962 | Herz et al. | 430/607 |
| 3,184,313 | 5/1965 | Rees et al. | 430/606 |
| 3,260,597 | 7/1966 | Weyerts et al. | 430/240 |
| 3,318,701 | 5/1967 | Corben | 430/456 |
| 3,364,028 | 1/1968 | Konig | 430/613 |
| 3,409,437 | 11/1968 | Copeland et al. | 430/611 |
| 3,447,925 | 6/1969 | Dersch et al. | 430/423 |
| 3,615,617 | 10/1971 | Cologne et al. | 430/614 |
| 3,751,249 | 8/1973 | Hiller | 430/353 |
| 3,791,830 | 2/1974 | Abele | 430/611 |
| 3,839,041 | 10/1974 | Hiller | 430/352 |
| 4,243,748 | 1/1981 | Elsner et al. | 430/600 |
| 4,463,082 | 7/1984 | Ferguson et al. | 430/228 |
| 4,511,644 | 4/1985 | Okamura et al. | 430/219 |
| 4,788,132 | 11/1988 | Deguchi et al. | 430/505 |
| 4,840,871 | 6/1989 | Peters et al. | 430/203 |
| 4,952,491 | 8/1990 | Nishidawa et al. | 430/570 |
| 4,960,689 | 10/1990 | Nishikawa et al. | 430/603 |
| 5,116,723 * | 5/1992 | Kajiwara et al. | 430/611 |
| 5,478,721 | 12/1995 | Lok | 430/611 |

FOREIGN PATENT DOCUMENTS

| | | |
|---|---|---|
| 1186441 | 3/1962 | (GB) . |

* cited by examiner

*Primary Examiner*—Hoa Van Le
(74) *Attorney, Agent, or Firm*—Sarah Meeks Roberts

(57) ABSTRACT

This invention relates to a silver halide photographic element comprising a reflective support having situated thereon a non-tabular silver halide emulsion layer, said emulsion layer being predominantly silver chloride and being in reactive association with a thiolic compound represented by Formula I:

(I)

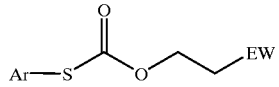

wherein Ar represents a substituted or unsubstituted aromatic or heteroaromatic ring; and EW represents an electron withdrawing group; and with a mercapto azole compound represented by Formula II:

(II)

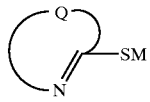

wherein Q represents the atoms necessary to form a substituted or unsubstituted five or six-membered heterocyclic ring containing at least one nitrogen atom, and M is a cation.

22 Claims, No Drawings

HIGH CHLORIDE SILVER HALIDE ELEMENTS CONTAINING ACTIVATED PRECURSORS TO THIOLIC STABILIZERS

CROSS REFERENCE TO RELATED APPLICATION

This is a continuation-in-part application of Ser. No. 09/224,213, filed Dec. 30, 1998, entitled "High Chloride Silver Halide Elements Containing Activated Precursors to Thiolic Stabilizers" by Roger Lok.

FIELD OF THE INVENTION

This invention relates to the use of certain thiolic compounds as stabilizers in silver halide photographic elements. The thiolic compounds are used in combination with certain mercapto azole compounds.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog can be defined as a developed density that is not associated with the action of the image-forming exposure, and is usually expressed as "D-min", the density obtained in the unexposed portions of the emulsion. Density, as normally measured, includes both that produced by fog and that produced as a function of exposure to light. It is known in the art that the appearance of photographic fog related to intentional or unintentional reduction of silver ion (reduction sensitization) can occur during many stages of preparation of the photographic element including silver halide emulsion preparation, spectral/chemical sensitization of the silver halide emulsion, melting and holding of the liquid silver halide emulsion melts, subsequent coating of silver halide emulsions, and prolonged natural and artificial aging of coated silver halide emulsions.

The chemicals used for preventing fog growth as a result of aging or storage are generally known as emulsion stabilizers. Prolonged storage, heat and high humidity often exacerbate such fog growth. Emulsion or raw stock stabilization is often referred to as storage stability or raw stock keeping (RSK).

The control of fog, whether occurring during the formation of the light-sensitive silver halide emulsion, during the spectral/chemical sensitization of those emulsions, during the preparation of silver halide compositions prior to coating on an appropriate support, or during the aging of such coated silver halide compositions, has been attempted by a variety of means. Mercury-containing compounds, such as those described in U.S. Pat. Nos. 2,728,663; 2,728,664; and 2,728,665, have been used as additives to control fog. Thiosulfonates and thiosulfonate esters, such as those described in U.S. Pat. Nos. 2,440,206; 2,934,198; 3,047,393; and 4,960,689, have also been employed. Organic dichalcogenides, for example, the disulfide compounds described in U.S. Pat. Nos. 1,962,133; 2,465,149; 2,756,145; 2,935,404; 3,184,313; 3,318,701; 3,409,437; 3,447,925; 4,243,748; 4,463,082; and 4,788,132 have been used not only to prevent formation of fog but also as desensitizers and as agents in processing baths and as additives in diffusion transfer systems. Organic compounds having a polysulfur linkage comprised of three or more sulfur atoms, and organic compounds having a heterocyclic ring having at least two thioether linkages or at least one disulfur linkage, such as those described in U.S. Pat. No. 5,116,723, in combination with nitrogen-containing cyclic compounds have also been discussed as suppressing fog and improving raw stock stability.

For highly sensitive silver chloride emulsions, storage fog is of particular concern. For these silver chloride emulsions, mercapto compounds and mercury salts are especially useful. The problem with stabilizers such as mercaptans and mercury salts is that when used in sufficient quantities to stabilize fog formation after storage, such stabilizers reduce the sensitivity of the emulsion considerably. Thus it is required that a mercaptan antifoggant be protected such that no sensitivity is lost when a sufficient amount is used to stabilize the emulsion. At the same time, it is also required that during incubation, when the temperature and humidity are high, the lability of the protecting group be sufficient to allow the mercaptan group to be revealed and the stabilizing function performed. Mercury compounds have the additional disadvantage of being harmful to the environment.

Mercaptan precursors have been taught in the photographic art. Azoles which hydrolyze in alkaline solution to yield mercaptoazoles are discussed in U.S. Pat. No. 3,260,597. U.S. Pat. No. 3,615,617 discusses the use of thiocarbonic acid esters and thiocarbamates as emulsion stabilizers. U.S. Pat. No. 4,840,871 describes a number of mercaptotetrazoles in which the mercaptan group is bonded to alkali labile substituents including sulfonylethyl groups ($—CH_2CH_2SO_2R$). U.S. Pat. No. 4,511,644 discusses the use of an alkoxycarbonylethyl ($—CH_2CH_2COOR$) moiety as a mercapto protecting group in a color diffusion transfer photographic element.

Alkoxycarbonyl (—COOR) protected mercapto heterocycles have also been mentioned in the photographic art. GB 1,186,441 discusses the stabilization of developed silver images with alkoxycarbonyl mercaptans in black and white photography. U.S. Pat. No. 3,364,028 describes the use alkoxycarbonyl mercaptans as yellow fog-preventing agents in photographic materials. U.S. Pat. Nos. 3,751,249 and 3,839,041 report the use alkoxycarbonyl mercaptan compounds for stabilization of the developed image in photothermographic elements. U.S. Pat. No. 4,952,491 discusses the use of alkoxycarbonyl protected mercaptan compounds in tabular silver chloride emulsions. U.S. Pat. No. 5,478,721 describes the use of similarly protected mercaptans in non-tabular silver chloride emulsions. One problem with the alkoxycarbonylmercaptans is that the protecting group does not have sufficient lability to fully allow the antifogging activity of the mercaptan compound to be realized during storage of the photographic coatings. U.S. Pat. No. 3,791,830 discusses the use of arylsulfonylethoxycarbonyl ($—COOCH_2CH_2SO_2Ar$) and arylthioethoxycarbonyl ($—COOCH_2CH_2SAr$) protected mercaptans in silver bromoiodide emulsions in color negative films.

Despite the vast amount of effort which has gone into methods to control fog in photographic elements there is a continuing need in the industry for practical and environmentally benign stabilizers, particularly for high chloride emulsions, which do not otherwise adversely affect the performance of the photographic element.

SUMMARY OF THE INVENTION

This invention provides a silver halide photographic element comprising a reflective support having situated thereon a non-tabular silver halide emulsion layer, said emulsion layer being predominantly silver chloride and being in reactive association with a thiolic compound represented by Formula I:

(I)

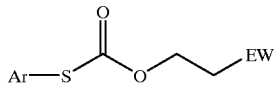

wherein Ar represents a substituted or unsubstituted aromatic or heteroaromatic ring; and EW represents an electron withdrawing group; and a mercapto azole compound represented by Formula II:

(II)

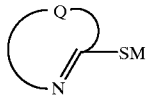

wherein Q represents the atoms necessary to form a substituted or unsubstituted five or six-membered heterocyclic ring containing at least one nitrogen atom, and M is a cation;

The photographic elements of this invention have improved resistance to storage induced changes such as the fog formation and sensitivity changes brought on by prolonged storage. The thiolic compounds contained in the silver halide elements of this invention utilize an activated mercaptan protecting group that may be unzipped readily during storage of the photographic element to reveal the antifogging mercaptan, thus providing the balance between antifogging action and high sensitivity (speed). Further, the thiolic compounds provide such improvements without deleteriously impacting the emulsion layer's fresh (i.e., unstored) sensitivity.

DETAILED DESCRIPTION OF THE INVENTION

The compounds utilized in the photographic elements of this invention are thiolic compounds represented by Formula I.

(I)

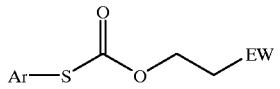

Ar represents a substituted or unsubstituted aromatic or heteroaromatic ring. The preferred aromatic groups have from 6 to 20 carbon atoms. More preferably, the aromatic groups have 6 to 10 carbon atoms and include, among others, phenyl and naphthyl groups. The heterocyclic groups are 3 to 1 5-membered rings, more preferably 5 to 6-membered rings, with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings. Preferably Ar represents a heteroaromatic group. Most preferably Ar represents represents a substituted or unsubstituted phenyl substituted tetrazole.

EW represents an electron withdrawing group. Examples of EW include, but are not limited to, an aryl or alkyl sulfonyl group, a cyano, nitro, trifluromethyl or trifluromethylsulfonyl group, an alkoxycarbonyl group (such as an ethoxycarbonyl or propoxycarbonyl group), a trialkylammonium group, (such as a trimethyl, triethyl, or tributyl ammonium group) or an acyl group (such as a acetyl, propanoyl, butanoyl or benzoyl group). The preferred EW groups are an aryl sulfonyl group or alkyl sulfonyl group. The most preferred EW group is a tolylsulfonyl group.

Specific examples of the thiolic compounds include, but are not limited to:

(1)

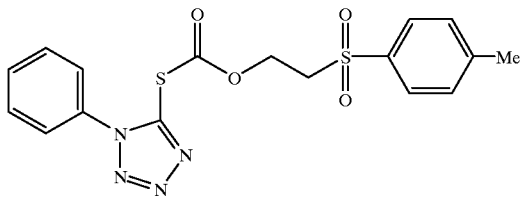

(2)

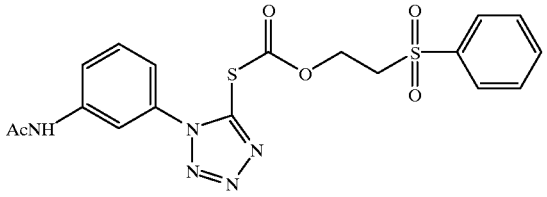

(3)

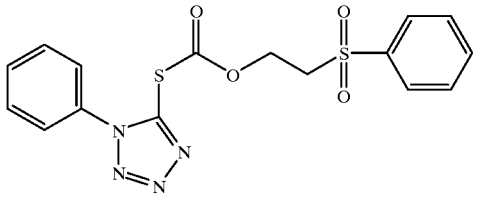

(4)

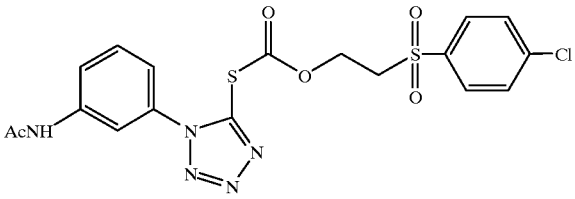

(5)

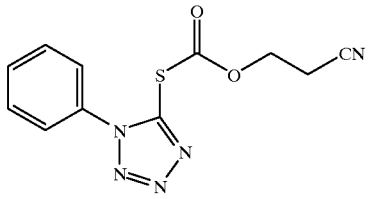

(6)

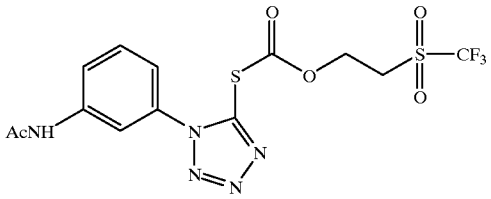

-continued (7)

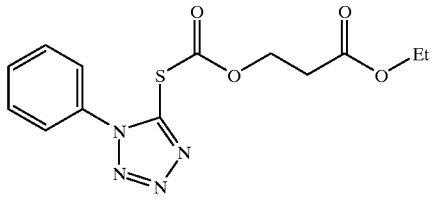

(8)

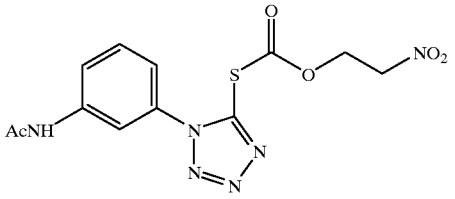

(9)

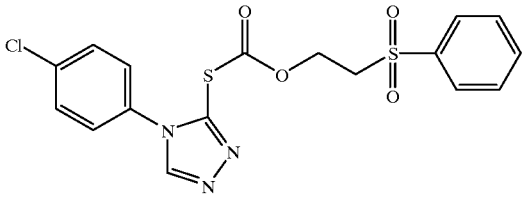

(10)

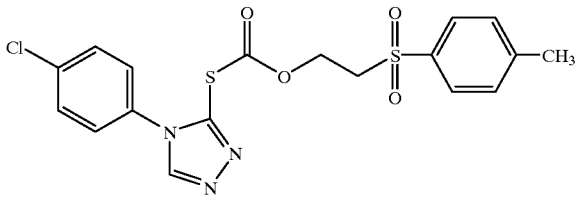

(11)

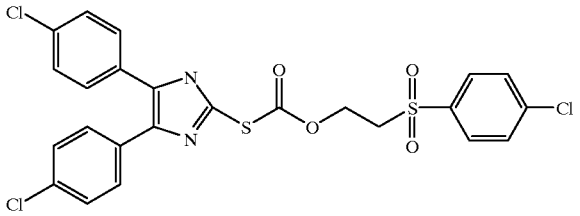

(12)

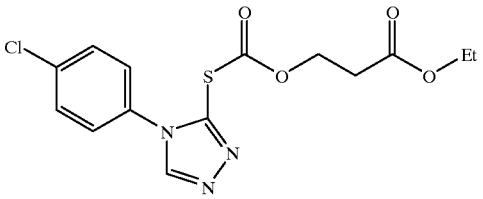

One method of preparing an activated alkoxycarbonyl protected mercaptan (one embodiment of a thiolic compound) is to synthesize the bromoethoxycarbonyl mercaptan. This is then treated with a sufinate salt as described in U.S. Pat. No. 3,791,830 as follows:

$$HetSH+ClCOOCH_2CH_2Br\rightarrow$$
$$HetSCOOCH_2CH_2BrHetSCOOCH_2CH_2Br+ArylSO_2Na\rightarrow$$
$$HetSCOOCH_2CH_2SO_2Aryl$$

The sulfinates are commercially available or they may be obtained by reduction of sulfonyl chlorides as taught in standard organic textbooks.

Another method of preparing the protected mercaptan is to treat the mercaptan with a chloroformate ester of the protecting group as follows:

$$HOCH_2CH_2Br+ArylSO_2Na\rightarrow HOCH_2CH_2SO_2ArylHetSH+$$
$$ClCOOCH_2CH_2SO_2Ar\rightarrow HetSCOOCH_2CH_2SO_2Aryl$$

Useful levels of the thiolic compound may range from about 1 mg to about 50,000 mg per silver mole. The preferred range may be from about 10 mg to about 25,000 mg per silver mole. A more preferred range is from about 100 mg to about 10,000 mg per silver mole. The most preferred range is from about 1000 mg to about 5000 mg/Ag mole. The thiolic compounds may be added as an acetone or methanol solution or in a gelatin dispersion.

The thiolic compounds may be added to any layer where they are in reactive association with the silver halide. By "in reactive association with" it is meant that the compounds must be contained in the silver halide emulsion layer or in a layer whereby they can react or interact with the silver halide emulsion. For example, the compounds can also be added to gelatin-only overcoats or interlayers. The thiolic compounds may be used in addition to any conventional emulsion stabilizer or antifoggant as commonly practiced in the art. Combinations of more than one thiolic compound may be utilized.

The mercapto azole compounds utilized in this invention are represented by Formula (II):

(II)

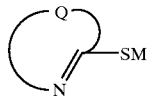

wherein Q represents the atoms necessary to complete a substituted or unsubstituted five or six-membered heterocyclic ring containing at least one heteroatom which is a nitrogen. M is a cation which may be hydrogen, a mono valent alkali metal cation or a tetrasubstituted ammonium cation. Preferred heterocyclic nuclei include tetrazoles, triazoles, imidazoles, oxadiazoles, thiadiazoles and benzothiazoles. Examples of suitable classes of compounds are shown below:

IIA

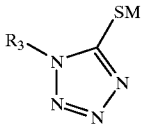

IIB

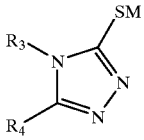

IIC

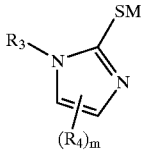

-continued

IID

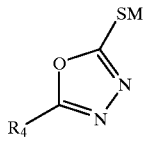

IIE

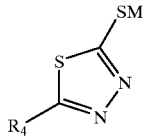

IIF

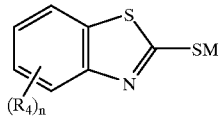

In the above examples M is an alkali metal cation or a tetrasubstituted ammonium cation. $R_3$ is selected from hydrogen or alkyl, aryl, carbonamido, sulfonamido, alkenyl, cycloalkyl, cycloalkenyl, alkinyl, sulfonyl, sulfinyl, phosphonyl, acyl, carbamoyl, sulfamoyl, amino, alkylamino, anilino, imido, ureido, sulfamoylamino, alkoxycarbonylamino, aryloxycarbonyl-amino, alkoxycarbonyl, and aryloxycarbonyl groups. $R_4$ is selected from the same substituents as $R_3$ and halogen, alkoxy, aryloxy, siloxy, acyloxy, or carbamoyloxy groups. m is 0, 1, or 2 and n is 0, 1, 2, 3 or 4. Preferably M is selected from Na or K.

In a preferred embodiment, the compound is the Na salt of a derivative of mercaptotetrazole, IIA. In a more preferred embodiment, the compound is the Na salt of a derivative of mercaptotetrazole, IIA wherein $R_3$ is selected from a alkyl, aryl, alkylcarbonamidoaryl, or arylcarbonamidoaryl group. In the most preferred embodiment, $R_3$ is acetamidophenyl and M is Na (IIAai).

IIAa

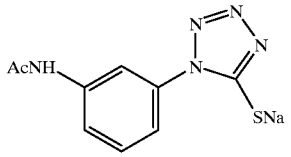

Useful levels of the mercapto azole may range from 0.01 mg to 10,000 mg per silver mole. Preferably, the range is from 0.1 mg to 1,000 mg per silver mole. A more preferred range is from 1 mg to 750 mg per silver mole. The most preferred range is from 10 mg to 500 mg/Ag mole.

Compounds of general formula IIA can be made as described in, for example, U.S. Pat. Nos. 2,403,927; 3,266,897; 3,397,987; 3,364,028; 3,708,303; 4,804,623; *Research Disclosure,* Vol. 116, December 1973, Item 11684; and EP 330,018 and EP 564,281.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment. After spectral sensitization, the emulsion is coated on a support. Various coating techniques include dip coating, air knife coating, curtain coating and extrusion coating.

The thiolic compounds of this invention may be added to the silver halide emulsion at any time during the preparation of the emulsion, i.e., during precipitation, during or before chemical sensitization or during final melting and co-mixing of the emulsion and additives for coating. It may also be added to the coupler dispersion. Most preferably, these compounds are added during final melting and co-mixing of the emulsion.

The mercapto azole compounds of this invention may be added to the silver halide emulsion at any time during the preparation of the emulsion, i.e., during precipitation, during or before chemical sensitization or during final melting and co-mixing of the emulsion and additives for coating. It may also be added to the coupler dispersion. Most preferably, these compounds are added just prior to or during chemical sensitization of the emulsion The silver halide emulsion layers which contain the stabilizer may be comprised of silver chloride, silver bromochloride, silver iodochloride, silver bromoiodochloride and silver iodobromochloride enulsions. In accordance with the invention, the silver halide emulsion is predominantly silver chloride. By predominantly silver chloride it is meant that the grains of the emulsion are greater than about 50 mol percent silver chloride. Preferably, they are greater than about 75 mol percent silver chloride; more preferably greater than about 90 mol percent silver chloride; and optimally greater than about 95 mol percent silver chloride.

The silver halide emulsions employed in the present invention are non-tabular emulsions; but otherwise they can contain grains of any size and any morphology. Thus, the grains may take the form of cubes, octahedrons, cubooctahedrons, or any of the other naturally occurring morphologies of cubic lattice type silver halide grains. Further, the grains may be irregular such as spherical grains.

As used herein, non-tabular emulsion is taken to mean that less than 50 percent, and preferably less than 25 percent, of the total projected area of the silver halide grains contained in the emulsion is occupied by tabular grains, wherein tabular grains are those grains having an aspect ratio of 2 or more. Preferably, the emulsion contains no tabular grains.

The grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin) or acid treated gelatin (pigskin gelatin) and gelatin derivatives—e.g., acetylated gelatin, phthalated gelatin and the like are specifically contemplated. When used, gelatin is preferably at levels of 0.01 to 100 grams per total silver mole Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, $^{2}$-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo- 1 -oxazolidinyl, 3-dodecyl-2,5 -dioxo-1 -imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N, N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfmyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The photographic elements of the invention can be single color elements or multicolor elements. The supports utilized in this invention are reflective supports such as are known in the art. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. The photographic elements of this invention must contain at least two silver halide emulsion layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, the contents of which are incorporated herein by reference In the following Table, reference will be made to (1) *Research Disclosure,* December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth Mason Publications, Ltd., Dudley Annex, 12a North Street, Emsworth, Hampshire P010 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. In one embodiment the described elements can be processed in the known color print processes such as the RA-4 process of Eastman Kodak Company, Rochester, N.Y.

The following examples illustrate the practice of this invention. They are not intended to be exhaustive of all possible variations of the invention.

EXAMPLES

Example 1

In accordance with the present invention, Compound (1) in amounts indicated in Table 1 was added to a 0.04 mol cubic silver iodochloride negative emulsion previously sensitized with a colloidal suspension of aurous sulfide, a blue spectral sensitizing dye, anhydro-5-chloro-3,3'-di(3 -sulfopropyl)-5'-(1 -pyrrolyl)thiazolothiacyanine hydroxide triethylammonium salt, potassium bromide, and Compound IIAa-(3-acetamidophenyl)-5-mercaptotetrazole. This emulsion further contained a yellow dye-forming coupler alpha-(4-(4-benzyloxy-phenylsulfonyl)phenoxy)-alpha(pivalyl)-2-chloro-5-(gamma-(2,4-di-5-amylphenoxy)butyramido) acetanilide (1.08 g/m$^2$) in di-n-butylphthalate coupler solvent (0.27 g/m$^2$), gelatin (1.51 g/m$^2$). The emulsion (0.34 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight.

To a second sample of the sensitized emulsion was added a similarly protected art-known antifoggant (A, U.S. Pat. No. 5,478,721) in amounts shown in Table 1. To a third sample of the above emulsion was added a known antifoggant, mercuric chloride to the yellow coupler dispersion at $5\times10^{-6}$ mol/kg of the coupler.

(A)

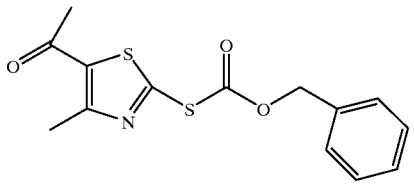

The coatings were given a 0.1 second exposure, using a 0–3 step tablet (0.15 increments) with a tunsten lamp designed to stimulate a color negative print exposure source. This lamp had a color temperature of 3000 K, log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C followed by drying (60 sec, 60° C.). The chemistry used in the Colenta processor consisted of the following solutions:

| Developer: | |
|---|---|
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2. | |

The data in Table I show the changes in fog density of the blue sensitized coatings after a four week storage at 120° F. relative to those kept at 0° F. Fog is measured as the minimum density (D-min) above zero. The speed taken at the 1.0 density point of the D log E curve is taken as a measure of the sensitivity of the emulsion.

It can be seen in Table 1 that samples of the present invention (7–10) which contain the combination of compounds (1) and (IIAa) have reduced fog growth compared to the control (sample 1) that has only the mercapto azole compound (IIAa). It is also clear that the art known stabilizer A when combined with (IIAa) in samples (3–6) is not as effective in fog suppression as those of the present inventive combination. The mercuric chloride in sample 2 suppresses fog growth relative to the control sample (1), but does not suppress fog better than the compounds in samples 9 and 10 of the present invention. It can be seen further that all samples have fresh fog positions that are very similar. That is to say, the compounds of the present invention have little fog impact on coatings that have not been incubated.

TABLE 1

| Sample | (IIAa) | (1) mg Ag mol | (A) | $HgCl_2$ | Fresh SPEED | D-MIN | 4 week 120 vs O°F. Δ D-MIN |
|---|---|---|---|---|---|---|---|
| 1 (comparison) | Y | 0 | 0 | 0 | 155 | 0.061 | 0.099 |
| 2 (comparison) | Y | 0 | 0 | Y | 156 | 0.062 | 0.056 |
| 3 (comparison) | Y | 0 | 250 | 0 | 155 | 0.053 | 0.067 |
| 4 (comparison) | Y | 0 | 500 | 0 | 154 | 0.058 | 0.068 |
| 5 (comparison) | Y | 0 | 750 | 0 | 154 | 0.055 | 0.068 |
| 6 (comparison) | Y | 0 | 1000 | 0 | 155 | 0.056 | 0.068 |
| 7 (invention) | Y | 250 | 0 | 0 | 156 | 0.054 | 0.070 |

TABLE 1-continued

| Sample | (IIAa) | (1) mg Ag mol | (A) | $HgCl_2$ | Fresh SPEED | D-MIN | 4 week 120 vs O°F. Δ D-MIN |
|---|---|---|---|---|---|---|---|
| 8 (invention) | Y | 500 | 0 | 0 | 156 | 0.059 | 0.058 |
| 9 (invention) | Y | 750 | 0 | 0 | 155 | 0.053 | 0.047 |
| 10 (invention) | Y | 1000 | 0 | 0 | 155 | 0.059 | 0.044 |

Example 2

In another practice of the invention, a negative iodochloride emulsion, doped with 0.12 μg/Ag mol of a transition metal salt $Cs_2Os(NO)Cl_5$, and 2 mg/Ag mol of bis[5-oxo-5,5'-[dithiobis(4,1-phenyleneimino)], pentanoic acid disodium salt (CAS# 165116-10-9) was similarly sensitized (that is, compound (IIAa) was also added during the sensitization as in Example 1) with a colloidal suspension of aurous sulfide at 40° C. as for Example 1. Compounds (B) and (1) in amounts indicated in Table 2 were added to the sensitized emulsion which was then doctored, coated, exposed and processed as for Example 1.

(B)

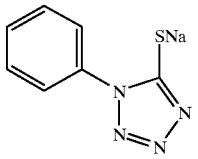

TABLE 2

| Sample | (IIAa) | (B) | (1) mg Ag mol | Fresh SPEED | D-MIN | 4 week 120vs 0°F. Δ D-MIN |
|---|---|---|---|---|---|---|
| 11 (comparison) | Y | 0 | 0 | 151 | 0.076 | 0.610 |
| 12 (comparison) | Y | 500 | 0 | 149 | 0.058 | 0.425 |
| 13 (comparison) | Y | 1500 | 0 | 132 | 0.056 | 0.183 |
| 14 (comparison) | Y | 3000 | 0 | 106 | 0.061 | 0.100 |
| 15 (invention) | Y | 0 | 750 | 152 | 0.067 | 0.459 |
| 16 (invention) | Y | 0 | 1000 | 153 | 0.065 | 0.393 |
| 17 (invention) | Y | 0 | 1500 | 152 | 0.066 | 0.313 |

The data in Table 2 show that samples (15–17) containing the combination of compounds (IIAa) and (1) show a decreased fog level compared to the control coating (sample 11) with only (IIAa) but without (1) after a four week storage at 120° F. Samples (12–14), containing an art-known antifoggant compound (B) lacking a protecting group, have reduced fog growth, but suffer from a marked reduction in emulsion sensitivity (speed) compared to those samples of the present invention.

Example 3

In another practice of the invention, the same negative iodochloride emulsion doped with $Cs_2Os(NO)Cl_5$, and bis[5-oxo-5,5'-[dithiobis(4,1-phenyleneimino)], pentanoic acid disodium salt (CAS# 165116–10-9) as in Example 2 was similarly sensitized ((IIAa) was added during the sensitization as per Example 1) and doctored as in Example 1. Compound (1) in amounts indicated in Table 3 was added to either the sensitized emulsion or to the coupler dispersion. The emulsions were coated, and the coatings stored, exposed and processed as for previous examples.

TABLE 3

| Sample | mg Ag mol emul | disp | Fresh SPEED | D-MIN | 4 week 120vs0°F. Δ D-MIN |
|---|---|---|---|---|---|
| 18 (comparison) | 0 | 0 | 143 | 0.055 | 0.050 |
| 19 (invention) | 1000 | 0 | 145 | 0.052 | 0.022 |
| 20 (invention) | 3000 | 0 | 147 | 0.053 | 0.017 |
| 21 (invention) | 6000 | 0 | 145 | 0.058 | 0.000 |
| 22 (invention) | 0 | 1000 | 141 | 0.053 | 0.024 |
| 23 (invention) | 0 | 3000 | 140 | 0.050 | 0.028 |
| 24 (invention) | 0 | 6000 | 139 | 0.055 | 0.036 |

It can be seen in Table 3 that the antifogging benefits of compound (1) of the present invention (samples 19–24) are realized by addition of (1) to either the emulsion or to the dispersion. It is however more beneficial to add (1) to the emulsion since the fog growth is less after 4 weeks (samples 19–21) than those with (1) in the dispersion (samples 22–24). In addition, there is a slight increase in emulsion sensitivity in samples where (1) was added to the emulsion than samples where (1) was added to the dispersion.

The invention has been described in detail with particular reference to the preferred embodiments thereof, but it will be understood that variations and modifications can be effected within the scope of the invention.

What is claimed is:

1. A silver halide photographic element comprising a reflective support having situated thereon a non-tabular silver halide emulsion layer, said emulsion layer being predominantly silver chloride and being in reactive association with a thiolic compound represented by Formula I:

(I)

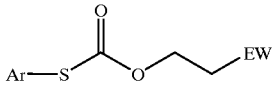

wherein Ar represents a substituted or unsubstituted aromatic or heteroaromatic ring; and EW represents an electron withdrawing group; and with a mercapto azole compound represented by Formula II:

(II)

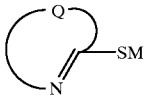

wherein Q represents the atoms necessary to form a substituted or unsubstituted five or six-membered heterocyclic ring containing at least one nitrogen atom, and M is a cation.

2. The photographic element of claim 1 wherein EW is an aryl or alkyl sulfonyl group or a cyano, nitro, triflurometh yl, trifluromethylsulfonyl, alkoxycarbonyl, trialkylammonium, or acyl group.

3. The photographic element of claim 2 wherein EW an aryl sulfonyl group.

4. The photographic element of claim 1 wherein Ar represents a substituted or unsubstituted aromatic group having 6 to 10 carbon atoms or represents a substituted or unsubstituted 3 to 15-membered heteroaromatic ring with at least one heteroatom being oxygen, nitrogen or sulfur.

5. The photographic element of claim 4 wherein Ar represents a substituted or unsubstituted 5 to 6-membered heteroaromatic ring with at least one heteroatom being nitrogen.

6. The photographic element of claim 5 wherein Ar represents a substituted or unsubstituted phenyl substituted tetrazole.

7. The photographic element of claim 2 wherein Ar represents represents a substituted or unsubstituted phenyl substituted tetrazole.

8. The photographic element of claim 1 wherein the thiolic compound is:

(1)

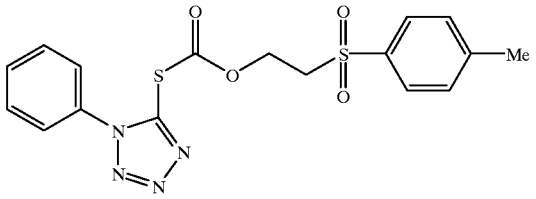

(2)

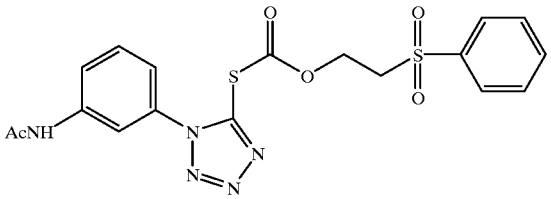

(3)

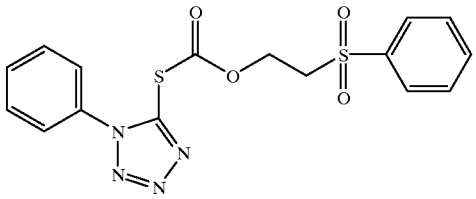

(4)

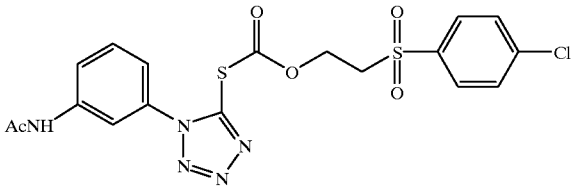

(5)

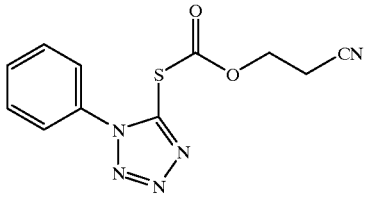

-continued (6)

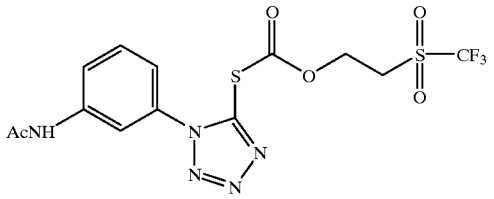

(7)

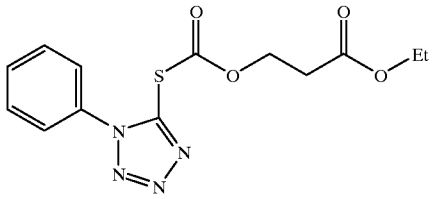

(8)

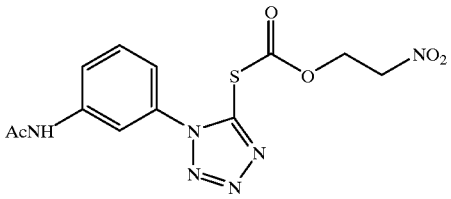

(9)

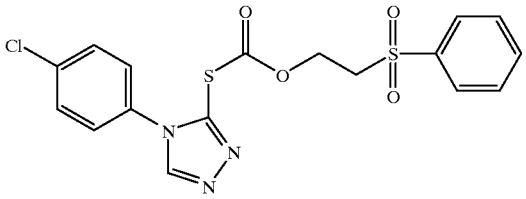

(10)

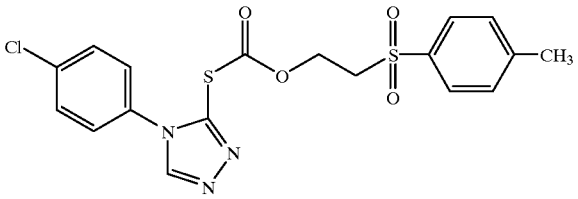

(11)

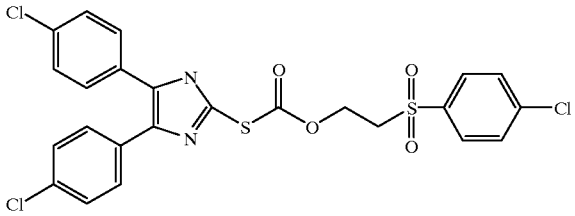

(12)

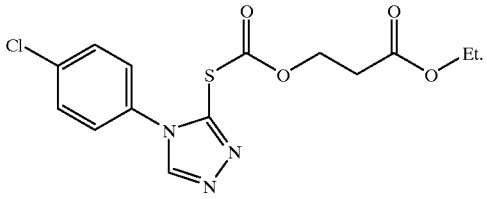

9. The photographic of claim 1 wherein the emulsion layer comprises greater than about 90 mol percent silver chloride.

10. The photographic element of claim 9 wherein the emulsion layer comprises greater than about 95 mol percent silver chloride.

11. The photographic of claim 7 wherein the emulsion layer comprises greater than about 90 mol percent silver chloride.

12. The photographic element of 7 wherein the emulsion layer comprises greater than about 95 mol percent silver chloride.

13. The photographic element of claim 1 containing from about 100 to about 10,000 mg per silver mol of the thiolic compound.

14. The photographic element of claim 13 containing from about 1,000 to about 5,000 mg per silver mol of the thiolic compound.

15. The photographic element of claim 1 wherein Q contains the atoms necessary to form a substituted or unsubstituted tetrazole, triazole, imidazole, oxadiazole, thiadiazole or benzothiazole heterocyclic ring.

16. The photographic element of claim 1 wherein M is a hydrogen atom, a monovalent alkali metal cation or a tetrasubstituted ammonium cation.

17. The photographic element of claim 15 wherein Q contains the atoms necessary to form a substituted or unsubstituted tetrazole heterocyclic ring and M is sodium.

18. The photographic element of claim 6 wherein Q contains the atoms necessary to form a substituted or unsubstituted tetrazole heterocyclic ring and M is sodium.

19. The photographic element of claim 7 wherein Q contains the atoms necessary to form a substituted or unsubstituted tetrazole heterocyclic ring and M is sodium.

20. The photographic element of claim 8 wherein Q contains the atoms necessary to form a substituted or unsubstituted tetrazole heterocyclic ring and M is sodium.

21. The photographic element of claim 1 wherein the mercapto azole compound is

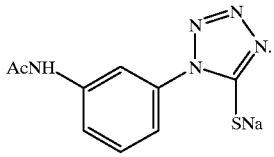

22. The photographic element of claim 8 wherein the mercapto azole compound is

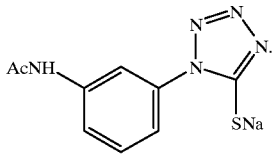

* * * * *